US009696689B2

(12) United States Patent
Hasegawa

(10) Patent No.: US 9,696,689 B2
(45) Date of Patent: Jul. 4, 2017

(54) ELECTRONIC TIMEPIECE

(71) Applicant: CASIO COMPUTER CO., LTD., Shibuya-ku, Tokyo (JP)

(72) Inventor: Kosuke Hasegawa, Fussa (JP)

(73) Assignee: CASIO COMPUTER CO., LTD., Tokyo (JP)

( * ) Notice: Subject to any disclaimer, the term of this patent is extended or adjusted under 35 U.S.C. 154(b) by 0 days.

(21) Appl. No.: 14/754,454

(22) Filed: Jun. 29, 2015

(65) Prior Publication Data

US 2016/0018792 A1 Jan. 21, 2016

(30) Foreign Application Priority Data

Jul. 18, 2014 (JP) ..... 2014-147642

(51) Int. Cl.
*G04R 20/00* (2013.01)
*G04R 20/02* (2013.01)
*G04G 9/00* (2006.01)

(52) U.S. Cl.
CPC ..... *G04G 9/0076* (2013.01); *G04R 20/00* (2013.01); *G04R 20/02* (2013.01)

(58) Field of Classification Search
CPC ..... G04R 20/00; G04G 9/0076
(Continued)

(56) References Cited

U.S. PATENT DOCUMENTS 5,724,316 A * 3/1998 Brunts ..... G01C 21/3697 368/47
5,842,146 A * 11/1998 Shishido ..... G01C 21/26 340/988

(Continued)

FOREIGN PATENT DOCUMENTS

CN 101208638 A 6/2008
JP 2000075070 A 3/2000

(Continued)

OTHER PUBLICATIONS

Nomenclature of the frequency and wavelength bands used in telecommunications, International Telecommunications Union, Aug. 2015, retreived on Oct. 20, 2016 from <https://www.itu.int/dms_pubrec/itu-r/rec/v/R-REC-V.431-8-201508-I!!PDF-E.pdf>, full document.*

(Continued)

*Primary Examiner* — Amy Cohen Johnson
*Assistant Examiner* — Daniel Wicklund
(74) *Attorney, Agent, or Firm* — Holtz, Holtz & Volek PC

(57) ABSTRACT

An electronic timepiece including: a clocking unit which counts current date and time; a daylight saving time application unit which applies daylight saving time information corresponding to positional information to the date and time counted by the clocking unit; a radio wave reception unit which receives radio waves including daylight saving time implementation information of a predetermined area; a daylight saving time information acquisition unit which acquires the daylight saving time implementation information from the received radio waves; a storage unit in which a daylight saving time implementation rule of each area in the world is stored in advance; and an information selection unit which selects, as the daylight saving time information, one of the daylight saving time implementation information and the daylight saving time implementation rule corresponding to a current position on the basis of the current position and the daylight saving time implementation information.

8 Claims, 3 Drawing Sheets

(58) Field of Classification Search
USPC ..... 368/47, 21
See application file for complete search history.

(56) References Cited

U.S. PATENT DOCUMENTS 6,219,303 B1 * 4/2001 Morohoshi ..... G04G 5/00 368/187
6,298,014 B1 * 10/2001 Kihara ..... G04G 5/002 368/46
6,563,765 B1 * 5/2003 Ishigaki ..... G04G 5/002 368/47
6,999,787 B2 * 2/2006 Zschintzsch ..... G04G 5/002 455/418
8,077,550 B2 * 12/2011 Akiyama ..... G04G 5/002 368/21
8,385,156 B2 2/2013 Ozawa
8,937,851 B2 1/2015 Matsuo et al.
2002/0136094 A1 * 9/2002 Kawai ..... G04G 9/0076 368/47
2006/0158963 A1 * 7/2006 O'Neill ..... G04G 3/00 368/46
2007/0164903 A1 * 7/2007 Takada ..... G04R 20/10 342/389
2008/0165628 A1 * 7/2008 Urano ..... G04C 9/02 368/47

FOREIGN PATENT DOCUMENTS

JP 2011252931 A 12/2011
JP 2013072672 A 4/2013

OTHER PUBLICATIONS

Japanese Office Action (and English translation thereof) dated Apr. 25, 2017, issued in counterpart Japanese Application No. 2014-147642.
Chinese Office Action (and English translation thereof) dated Apr. 12, 2017, issued in counterpart Chinese Application No. 201510427627.X.

* cited by examiner

FIG.1

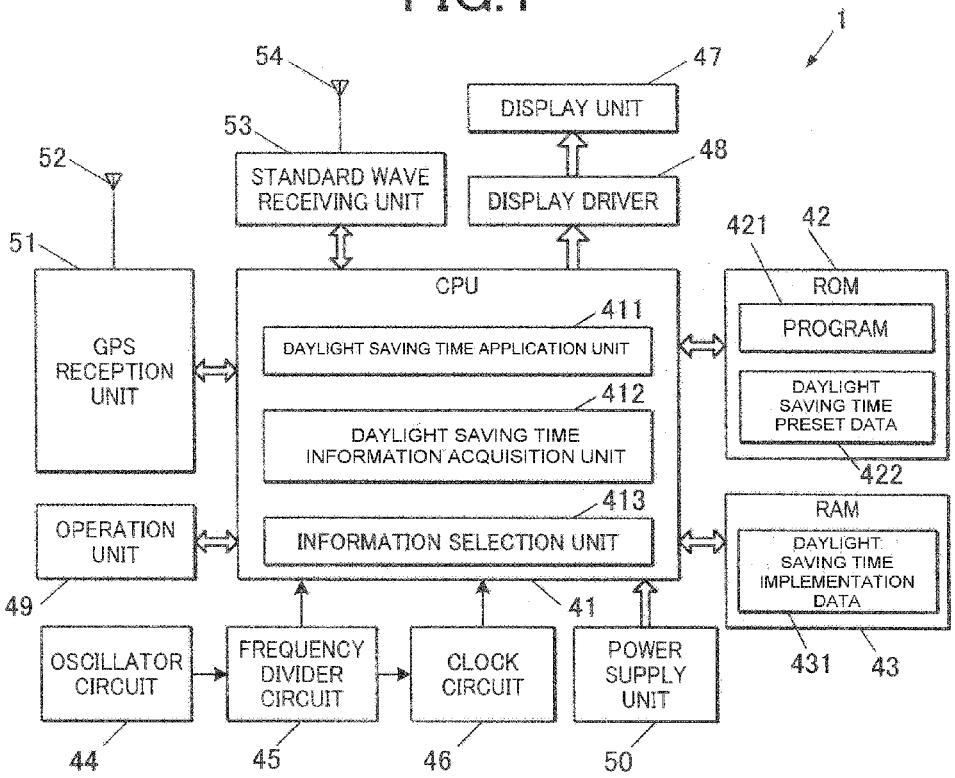

FIG.2

| AREA NUMBER | DAYLIGHT SAVING TIME | PRIORITY INFORMATION | CITY | SHIFT AMOUNT |
|---|---|---|---|---|
| 1 | NOT IMPLEMENTED | STANDARD WAVES | TYO | 0 |
| 2 | NOT IMPLEMENTED | PRESET | SEL | 0 |
| 3 | 2:00 ON 2nd SUNDAY OF MARCH – 2:00 ON 1st SUNDAY OF NOVEMBER | STANDARD WAVES | NYC | +1 |
| 4 | NOT IMPLEMENTED | PRESET | PHX | 0 |
| 5 | NOT IMPLEMENTED | PRESET | HMO | 0 |
| 6 | 2:00 ON 2nd SUNDAY OF MARCH – 2:00 ON 1st SUNDAY OF | STANDARD WAVES | TIJ | +1 |
| 7 | 2:00 ON 1st SUNDAY OF APRIL – 2:00 ON 4th SUNDAY OF OCTOBER | PRESET | MEX | +1 |

ELECTRONIC TIMEPIECE

BACKGROUND OF THE INVENTION

1. Field of the Invention

The present invention relates to an electronic timepiece.

2. Description of Related Art

Conventionally, there have been electronic timepieces (atomic clocks) which have a function of receiving radio waves including date and time information from outside to obtain the date and time information. One of the radio waves which are the targets to be received by the atomic clocks is standard radio waves utilizing radio waves in the long-wavelength range. Since the standard radio waves travel for a long distance along the surface of the earth, the standard radio waves can be widely received in countries which have transmitter stations and the surrounding countries.

Date and time of an area (local time) determined for each transmitter station of the standard radio waves or UTC date and time (Coordinated Universal Time) is transmitted as the date and time information via the standard radio waves, and implementation status of daylight saving time in a predetermined area is also transmitted. There are electronic timepieces which can shift the date and time to be counted and displayed during the implementation of daylight saving time from standard time to daylight saving time. In such electronic timepieces, the current exact local time in an area corresponding to implementation/non-implementation of daylight saving time can be counted and displayed by obtaining the implementation status of daylight saving time from the standard radio waves.

However, detailed rules for implementing daylight saving time are different according to areas such as countries. There is a case where the user does not wish to apply the setting of standard radio waves in an area where the daylight saving time implementation rule is different from the daylight saving time implementation status transmitted via the standard radio waves, or there is a case where the atomic clock is used in an area where the standard radio waves are difficult to receive. For example, Japanese Patent Application Laid Open Publication No. 2011-252931 which is a Japanese patent document discloses a technique by which daylight saving time implementation rules are set in advance or a user can input to set the daylight saving time implementation rules so that the user can select by his/her operation whether to automatically use the daylight saving time implementation status obtained via the standard radio waves or determine the daylight saving time implementation status and the period of time by applying the preset data or user's input setting.

However, the conventional techniques have a problem that the user needs to perform extra work of searching the transmitted contents of standard radio waves and the latest daylight saving time implementation rule in the area so as to appropriately perform the above selection every time the user moves between areas which have different daylight saving time implementation rules or areas which receive different standard radio waves.

An object of the present invention is to provide an electronic timepiece which enables a user to obtain date and time to which preferable settings according to daylight saving time is applied in each area of the world without creating extra work for the user.

SUMMARY OF THE INVENTION

According to one aspect of the present invention, there is provided an electronic timepiece including: a clocking unit which counts current date and time; a daylight saving time application unit which applies daylight saving time information corresponding to positional information to the date and time counted by the clocking unit; a radio wave reception unit which receives radio waves including daylight saving time implementation information of a predetermined area; a daylight saving time information acquisition unit which acquires the daylight saving time implementation information from the received radio waves; a storage unit in which a daylight saving time implementation rule of each area in the world is stored in advance; and an information selection unit which selects, as the daylight saving time information, one of the daylight saving time implementation information and the daylight saving time implementation rule corresponding to a current position on the basis of the current position and the daylight saving time implementation information acquired by the daylight saving time information acquisition unit, wherein the daylight saving time application unit applies the one selected as the daylight saving time information to the date and time.

BRIEF DESCRIPTION OF THE DRAWINGS

The above and other objects, advantages and features of the present invention will become more fully understood from the detailed description given hereinafter and the appended drawings which are given by way of illustration only, and thus are not intended as a definition of the limits of the present invention, and wherein:

FIG. 1 is a block diagram showing a functional configuration of an electronic timepiece of the present invention;

FIG. 2 is a diagram showing a part of an example of setting in a daylight saving time information table;

DETAILED DESCRIPTION OF THE PREFERRED EMBODIMENT

Figure 3A:
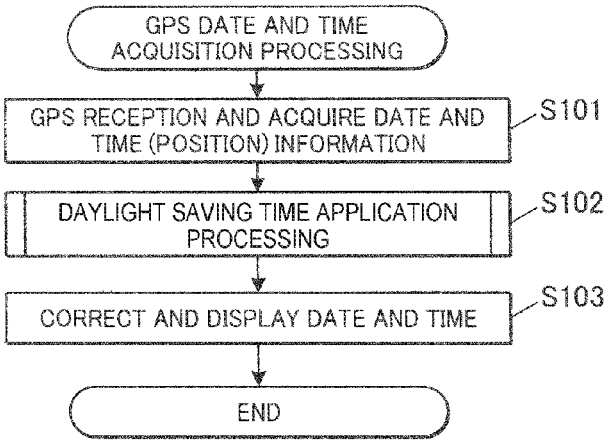
FIG. 3A is a flow chart showing a control procedure of GPS date and time acquisition processing.

Hereinafter, an embodiment of the present invention will be described on the basis of the drawings.

FIG. 1 is a block diagram showing a functional configuration of an electronic timepiece 1 which is an embodiment of the present invention.

The electronic timepiece 1 includes a CPU 41 (Central Processing Unit)(daylight saving time application unit 411, daylight saving time information acquisition unit 412 and information selection unit 413), a ROM 42 (Read Only Memory) (storage unit), a RAM 43 (Random Access Memory), an oscillator circuit 44, a frequency divider circuit 45, a clock circuit 46 (clocking unit), a display unit 47, a display driver 48, an operation unit 49 (operation unit), a power supply unit 50, a GPS reception unit 51 (positioning unit), an antenna thereof 52, a standard wave receiving unit 53 (radio wave reception unit), an antenna 54 thereof and such like.

The CPU 41 carries out various calculation processes and comprehensively controls the entire operation of the electronic timepiece 1. The CPU 41 loads control programs read out from the ROM 42 into the RAM 43 to perform various types of operation processing such as display of date and time and calculation control and display according to various functions. The CPU 41 also operates the GPS reception unit 51 to acquire date and time information and positional information, and decodes time signal output (TCO) of standard radio waves input from the standard wave receiving unit 53 to acquire date and time information and daylight saving time implementation information. The CPU 41 includes a daylight saving time application unit 411, a daylight saving time information acquisition unit 412 and an information selection unit 413. The daylight saving time application unit 411, daylight saving time information acquisition unit 412 and information selection unit 413 may be a single CPU 41 or may be provided as separate CPUs to perform respective operations.

The ROM 42 is a mask ROM, a rewritable non-volatile memory and such like. Control programs and initial setting data are stored in the ROM 42 in advance. The control programs include a program 421 according to control such as position acquisition control processing and date and time acquisition control processing for acquiring various types of information from positioning satellites. The initial setting data includes the range of each time zone, information according to time difference of the time zone and daylight saving time preset data 422 (daylight saving time implementation rule) according to implementation schedule of daylight saving time in each area of the world, for example.

The RAM 43 is a volatile memory such as a SRAM and a DRAM which stores temporary data by providing a working memory to the CPU 41 and stores various types of setting data. The various types of setting data include daylight saving time implementation data 431 according to daylight saving time implementation information acquired via the standard radio waves. That is, the daylight saving time implementation data 431 includes the type of the acquired standard radio waves, the timing of the acquisition, whether the daylight saving time is implemented at the timing, and switching of the implementation status in a predetermined period of time (approximately 1 to several hours according to the standard radio waves and the reception position) after the timing.

The oscillator circuit 44 generates and outputs predetermined frequency signals. The oscillator circuit 44 includes, for example, a crystal oscillator.

The frequency divider circuit 45 divides a frequency signal input from the oscillator circuit 44 into signals having frequencies to be used in the clock circuit 46 and the CPU 41. The frequencies of the output signals may be changeable on the basis of setting by the CPU 41. Also, the signals may be output remaining the frequency of the oscillator circuit 44.

The clock circuit 46 counts the current date and time by counting the number of input signals and adding the counted value to the initial value. The clock circuit 46 may change a value stored in the RAM by software or may include a dedicated counter circuit.

The display unit 47 includes a display screen such as a liquid crystal display (LCD) and an organic EL (Electro-Luminescent) display, for example, and performs digital display operation according to date and time and various functions by either one or a combination of the dot matrix system and the segment system. The display driver 48 outputs a drive signal corresponding to the type of display screen to the display unit 47 on the basis of the control signal from the CPU 41 and performs display on the display screen.

The operation unit 49 receives an input operation from a user and outputs an electric signal corresponding to the input operation as an input signal to the CPU 41. The operation unit 49 includes push button switches and a crown switch, for example.

Alternatively, the display unit and the operation unit may be integrally provided by providing a touch sensor so as to be superposed on the display screen of the display unit 47 and making the touch sensor function as a touch panel which outputs an operation signal corresponding to a touch position and a touch manner according to the user's touch operation to the touch sensor.

The power supply unit 50 supplies electric power according to the operation of the electronic timepiece 1 to the units at a predetermined voltage. As the power supply unit 50, a solar battery and a secondary cell are used, for example. The solar battery generates an electromotive force by incident light to a solar panel to supply electric power to the units such as the CPU 41. When excess electric power is generated, the solar battery charges the secondary cell with the electric power. On the other hand, when the electric power which can be generated from the incident light to the solar panel from outside is insufficient compared to the consumed power, the electric power is supplied from the secondary cell. Alternatively, a dry cell may be used as the power supply unit 50.

The GPS reception unit 51 is tuned to radio waves from positioning satellites via the antenna 52 and receives the radio waves by identifying and acquiring C/A code (pseudorandom noise) and demodulates and decodes navigation message transmitted by the positioning satellites to acquire necessary information (information regarding date and time, orbit information of positioning satellites, status signal of positioning satellites and such like). When acquiring positioning information, the GPS reception unit 51 demodulates and decodes navigation messages, in parallel, with respect to radio waves from a plurality of positioning satellites, and calculates the current position by using the obtained data. A module formed as one chip of dedicated processing circuit is normally used as the GPS reception unit 51. The GPS reception unit 51 includes a CPU to perform control and a storage unit to store setting data, predicted orbit information of positioning satellites and such like, separately from the CPU 41, ROM 42 and RAM 43. The electric power is directly supplied from the power supply unit 50 to the GPS reception unit 51 and the on/off thereof is switched by a control signal from the CPU 41.

The standard wave receiving unit 53 is tuned to radio waves of a predetermined frequency in a long-wavelength range, receives the radio waves via the antenna 54 and demodulates the radio waves. When standard radio waves transmitting date and time information are received, the standard wave receiving unit 53 makes the standard radio waves into binary signals according to the format of receiving station and outputs the signals to the CPU 41. The standard wave receiving unit 53 may include a configuration for binarization such as an A/D convertor and a comparator which compares a signal voltage with a predetermined voltage, for example. The standard radio waves which is the reception target include JJY (registered trademark) of Japan, WWVB of the United States, MSF of the United Kingdom and DCF 77 of Germany, for example.

Next, the operation to acquire date and time information in the embodiment will be described.

In the electronic timepiece 1 in the embodiment, when date and time information included in transmitted radio waves (navigation messages) of positioning satellites such as GPS satellite or date and time information included in TCO of standard radio waves is acquired, the date and time counted by the clock circuit 46 is corrected by using the acquired date and time information. These reception operations are executed periodically once a day at predetermined time or at a timing when a predetermined condition is satisfied first, for example.

The date and time acquired by GPS satellite is UTC date and time, and the date and time transmitted by standard radio waves is local time or UTC date and time of a time zone determined for each transmitter station of the standard radio waves. Accordingly, in order to acquire the local time used for the counting, display and processing in the electronic timepiece 1, it is necessary to shift the received date and time in consideration of time difference and implementation/non-implementation of daylight saving time in each area.

Though not especially limited, the date and time of clock circuit 46 is counted to be the local time (home date and time) in the area (home city) which is set to be home. Accordingly, in a case where a user moves from the home city to an area in another time zone, when the positional information of the area is acquired, the home date and time is converted into the local time of the area where the user stays to be displayed and used on the basis of the time difference information and the daylight saving time information corresponding to the position. In the electronic timepiece 1, the time difference information (information of time zone) is stored in the ROM 42 in advance, and when the positional information is acquired, the time zone to which the position belongs is determined and the time difference from the home city is acquired.

In the electronic timepiece 1 of the embodiment, the above mentioned daylight saving time implementation information or a daylight saving time implementation rule is used as the daylight saving time information. The daylight saving time implementation rule is stored as daylight saving time preset data 422 in the ROM 42 so as to be associated with each area in the world similarly to the time difference information. The daylight saving time implementation rule may be set for each area having a same implementation condition completely independently from time zones, or may be set as a subset inside each time zone. Alternatively, the time difference information and daylight saving time implementation rule may be stored in parallel in a same table separately from or together with the time zone and daylight saving time implementation area for each section having same setting and implementation condition.

Here, the daylight saving time implementation rule for each area stored in the daylight saving time preset data 422 includes priority information which indicates, when the area is a reception area of standard radio waves, whether the daylight saving time implementation information included in TCO of the standard radio waves is to be applied in the area, that is, whether the daylight saving time implementation information of TCO can be used with priority over the implementation rule which is set in advance in the daylight saving time preset data 422.

The reception area of standard radio waves is uniformly determined by a condition such as an area in the same country of the transmitter station of the standard radio waves and/or an area within a predetermined distance from the radio wave transmitter station.

The daylight saving time preset data 422, especially priority information, may be changeable according to the input operation to the operation unit 49 by the user in a case where the data is stored in a rewritable non-volatile memory, for example. Alternatively, in a case where the daylight saving time information of the area to be displayed and counted is set and stored in the RAM 43 to be used, the data may be changeable.

FIG. 2 is a diagram which shows a part of the contents set as the daylight saving time preset data 422 in the electronic timepiece of the embodiment.

As for a predetermined lat/long range (latitude longitude range) in Japan indicated by the area number 1 including Tokyo (TYO), it is preset (registered) in the daylight saving time preset data 422 that the daylight saving time is not implemented (shift time is 0 hour). However, the setting indicates using, with priority, the daylight saving time implementation information included in TCO of the JJY in a case where Japanese JJY is received via standard radio waves.

On the other hand, as for a predetermined lat/long range in Korea indicated by the area number 2 including Seoul (SEL), the daylight saving time is not implemented similarly to Japan. However, by the area being outside the reception area of JJY, it is possible to set that the daylight saving time implementation rule of daylight saving time preset data 422 is used with priority regardless of whether the daylight saving time implementation rule matches the daylight saving time implementation information shown by the TCO of JJY.

In a predetermined lat/long range indicated by the area number 3 including New York (NYC), for an area belonging to the Eastern Standard Time (EST) in the U.S., for example, it is preset in the daylight saving time preset data 422 that daylight saving time is implemented from 2:00 on the 2nd Sunday of March (standard time) to 2:00 on the 1st Sunday of November (daylight saving time) and the time is shifted by +1 hour. However, it is set that daylight saving time implementation information included in TCO of WWVB is used with priority when the WWVB of the U.S. is received via the standard radio waves.

On the other hand, in a lat/long range in Arizona of US indicated by the area number 4 including Phoenix (PHX), the daylight saving time is not implemented at present. Accordingly, information regarding daylight saving time being not implemented is preset in the daylight saving time preset data 422. Since the daylight saving time implementation rule unique to the Arizona is not transmitted by WWVB, the daylight saving time implementation rule of daylight saving time preset data 422 is set to be used with priority without using the daylight saving time implementation information of WWVB even when the reception of the WWVB is performed.

Similarly, in a lat/long range in Sonora of Mexico indicated by the area number 5 including Hermosillo (HMO), daylight saving time is not implemented at present. Accordingly, when the date and time information is acquired in the lat/long range, the daylight saving time implementation rule stored in the daylight saving time preset data 422 is used with priority even if the WWVB is received.

On the other hand, in a lat/long range of Baja Calif. in the same Mexico indicated by the area number 6 including Tijuana (TIJ), daylight saving time is implemented during the same period of time as that of major regions in the U.S. Accordingly, it is set to implement daylight saving time by using, with priority, the daylight saving time implementation information included in TCO of WWVB and shifting the standard time in the time zone by +1 hour when the WWVB is received.

In a lat/long range of most regions in Mexico indicated by the area number 7 including the Mexico City (MEX) excluding the above-mentioned Sonora and Baja Calif., daylight saving time is implemented during a period of time different from that of the U.S., that is, from 2:00 on the 1st Sunday of April (standard time) to 2:00 on the 4th Sunday of October (daylight saving time). Accordingly, even within the reception area of WWVB, the daylight saving time implementation rule stored in the daylight saving time preset data 422 is used with priority in the lat/long range.

FIG. 3A is a flow chart showing a control procedure of GPS date and time acquisition processing executed by the CPU 41 of the electronic timepiece 1 in the embodiment.

The GPS date and time acquisition processing is started by user's input operation to the operation unit 49, automatic invocation which is made once a day at a timing when a predetermined condition is satisfied for the first time, and such like.

As shown in FIG. 3A, when the GPS date and time acquisition processing is started, the CPU 41 operates the GPS reception unit 51 to start receiving radio waves from positioning satellites such as GPS satellite and calculate date and time, and acquires information regarding the calculated date and time (step S101). At this time, it is possible to acquire positional information together on the basis of user's operation or by performing positioning at a predetermined frequency.

The CPU 41 executes after-mentioned daylight saving time application processing (step S102). The CPU 41 corrects date and time of the clock circuit 46 and corrects date and time displayed on the display unit 47 (step S103). Then, the CPU 41 ends the GPS date and time acquisition processing.

Figure 3B:
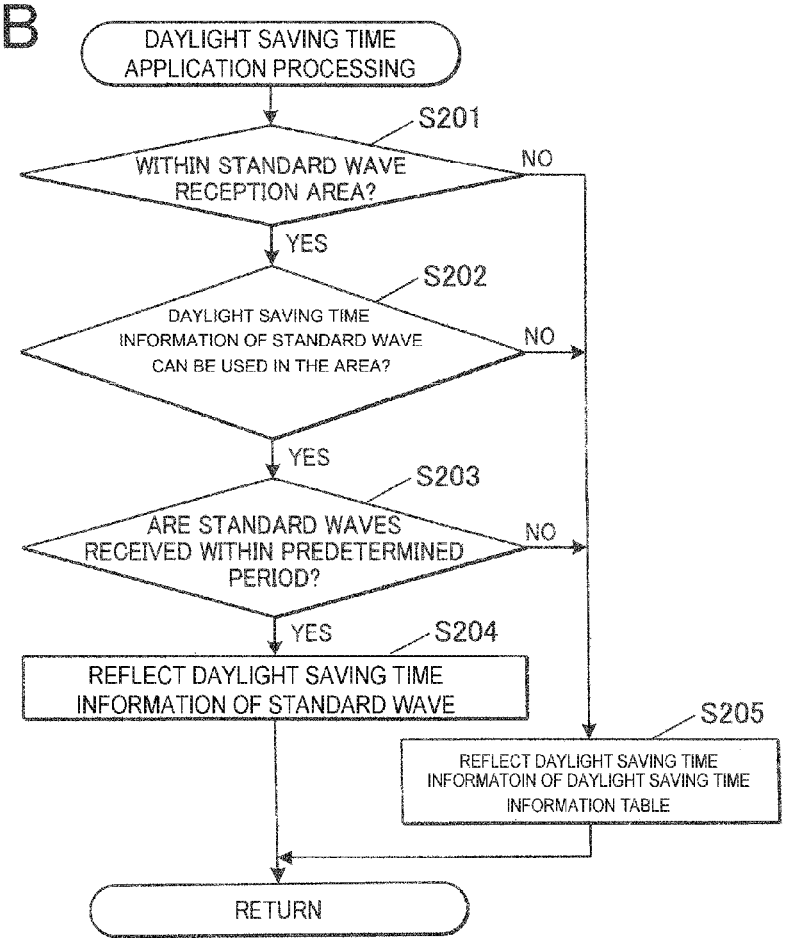
FIG. 3B is a flow chart showing a control procedure of daylight saving time application processing.

When daylight saving time application processing is invoked, as shown in FIG. 3B, the CPU 41 determines whether the current position for which positioning was performed in the processing of step S101 or the current position which is set in advance by user's operation is within a reception area of any standard radio waves (step S201). If it is not determined that the current position is within the reception area (step S201: NO), the CPU 41 acquires the daylight saving time implementation rule of daylight saving time preset data 422 for the current position and reflects the acquired daylight saving time implementation rule in the current date and time (step S205). The CPU 41 ends the daylight saving time application processing and returns the processing to the GPS date and time acquisition processing.

If it is determined that the current position is within the reception area of standard radio waves (step S201: YES), the CPU 41 determines whether the current position is in an area where the daylight saving time implementation information included in the TCO of standard radio waves may be used with priority (step S202). If it is not determined that the current position is in the area where the daylight saving time implementation information of standard radio waves may be used with priority (step S202: NO), the CPU 41 shifts the processing to step S205.

If it is determined that the current position is in the area where the daylight saving time implementation information of standard radio waves may be used with priority (step S202: YES), the CPU 41 determines whether the date and time information and the daylight saving time implementation information are acquired via the standard radio waves in the area within a predetermined period of time from the current date and time (step S203). Here, the predetermined period of time is appropriately set. However, immediately before the timing to start or end the daylight saving time implementation on the basis of the daylight saving time implementation rule stored in the daylight saving time preset data 422, it is preferable that the standard radio waves are received within a range corresponding to a period of time when notice information of start or end of daylight saving time implementation is transmitted via the standard radio waves of the reception target. For example, in WWVB, notice information is started to be transmitted at UTC 0:00 on the days when daylight saving time is implemented and ends, and daylight saving time is started at 2:00 of Eastern Standard Time (GMT-5) in New York. Thus, it is preferable to receive standard waves within 7 hours before the starting date and acquire the daylight saving time implementation information.

If it is not determined that the date and time information and the daylight saving time implementation information are acquired (step S203: NO), the CPU 41 shifts the processing to step S205.

If it is determined that the date and time information and the daylight saving time implementation information are acquired (step S203: YES), the CPU 41 reflects the daylight saving time implementation information acquired via the standard radio waves in the current date and time (step S204). Then, the CPU 41 ends the daylight saving time application processing and returns the processing to the GPS date and time acquisition processing.

As described in the above example of Seoul, in a case where the daylight saving time preset data 422 includes the setting to use, with priority, the daylight saving time implementation rule of daylight saving time preset date 422 outside the standard radio waves reception area, the priority information of daylight saving time preset data 422 is acquired for the acquired current position, and thereby the processing of step S201 is executed at the same time in the processing of step S202. Thus, the processing of step S201 may be omitted.

It is possible to store respective pieces of daylight saving time implementation information in parallel in the daylight saving time implementation data 431, the pieces of daylight saving time implementation information being transmitted from transmitter stations of respective standard radio waves and being received and acquired by the standard wave receiving unit 53. The information of acquisition timing (reception timing of standard radio waves) of daylight saving time implementation information is stored so as to be associated with the daylight saving time implementation information stored in the daylight saving time implementation data 431. The information of acquisition timing is used for determination of the predetermined period of time according to the determination processing of step S203.

In a case where the daylight saving time implementation information different from the daylight saving time implementation rule is acquired via the standard radio waves, the daylight saving time implementation rule may be overwritten to be updated by the daylight saving time implementation information or the daylight saving time implementation information may be separately stored as latest daylight saving time preset data. Thus, it is possible to prevent the display from returning to the display of date and time based on the conventional daylight saving time implementation rule in a case where the standard radio waves cannot be received temporarily during the period of time of acquiring daylight saving time implementation information different from conventional daylight saving time implementation rules. Furthermore, in a case where the latest daylight saving time preset data is stored separately, the latest data may be effective until December 31 of the current year or may be effective also in the following years. Also, when the effective period of time is until December 31 of the current year, around the timings of starting and ending the daylight saving time implementation and/or around the timing when the switching is not performed though the conventional daylight saving time was started and ended, the reception processing for receiving notice information may be performed in order to determine whether the daylight saving time of the year will also be implemented in the following years.

Figure 4:
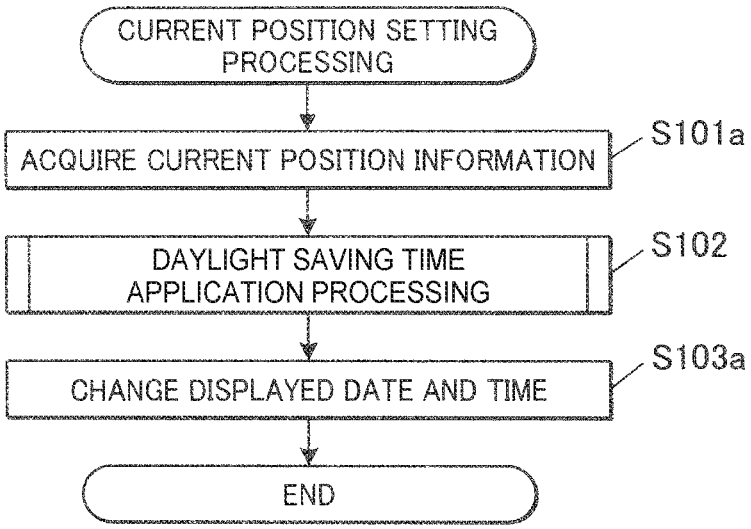
FIG. 4 is a flow chart showing a control procedure of current position setting processing.

FIG. 4 is a flow chart showing a control procedure of current position setting processing executed by the CPU 41 in the electronic timepiece 1.

In the current position setting processing, the processes of steps S101 and S103 in the GPS date and time acquisition processing are replaced with the processes of steps S101*a* and S103*a*, respectively.

When the current position setting processing is started, the CPU 41 acquires positional information of the current position set by the input operation to the operation unit 49 (step S101*a*). The CPU 41 executes the above-mentioned daylight saving time application processing on the basis of the acquired positional information (step S102), and outputs a control signal to the display driver 48 to switch the display to the acquired local time based on the daylight saving time (step S103*a*). Then, the CPU 41 ends the current position setting processing.

As described above, the electronic timepiece 1 in the embodiment includes the clock circuit 46 which counts the current date and time, the standard wave receiving unit 53 which receives radio waves including daylight saving time implementation information of a predetermined area, the ROM 42 which stores daylight saving time implementation rules of respective areas in the world in advance, the CPU 41 and such like. The CPU 41 (daylight saving time application unit 411) applies the daylight saving time information corresponding to positional information to the date and time counted by the clock circuit 46. The CPU 41 (daylight saving time information acquisition unit 412) acquires the daylight saving time implementation information from the received radio waves. The CPU 41 (information selection unit 413) selects, as daylight saving time information, the daylight saving time implementation information or the daylight saving time implementation rule corresponding to the current position on the basis of the current position and the acquired daylight saving time implementation information, and applies the selected one as the daylight saving time information to the date and time.

Accordingly, since data which is more suitable for a user can be selected automatically from among the daylight saving time implementation rule stored in advance and the daylight saving time implementation information acquired from the standard radio waves, it is possible to acquire date and time to which the preferable setting according to daylight saving time is applied in each area in the world without requiring the user to perform extra work.

The ROM 42 stores, for each of the areas divided in advance, priority information indicating whether to select the daylight saving time implementation information with priority over the daylight saving time implementation rule in the area, the daylight saving time implementation information being included in the radio waves which can be received by the standard wave receiving unit 53 in the area. Accordingly, the CPU 41 can easily determine which is to be used with priority and can display and count daylight saving time by performing appropriate selection without a load.

As for the priority information, it is determined in advance that the daylight saving time implementation information is selected with priority for an area where daylight saving time is implemented during a same period of time as the period of time indicated by the daylight saving time implementation information included in the radio waves which can be received by the standard wave receiving unit 53. Thus, as long as the information of standard radio waves can be used in the area, it is possible to count and display date and time corresponding to daylight saving time accurately on the basis of the latest information even when the daylight saving time implementation rule is changed.

The electronic timepiece 1 includes the operation unit 49 which receives the operation of changing priority information of the ROM 42. Thus, it is possible to perform minimum change of the setting according to partial change of daylight saving time implementation rule or such like in the reception area of standard radio waves.

The electronic timepiece 1 includes the GPS reception unit 51 which measures the current position, and the CPU 41 newly selects daylight saving time information on the basis of the current position when the GPS reception unit 51 measures the current position.

Accordingly, when the current position changes, it is possible to acquire the local time in consideration of daylight saving time by immediately switching to appropriate daylight saving time information.

The present invention is not limited to the above embodiment, and various changes can be made.

For example, whether there is a daylight saving time setting or not influences the home date and time itself of the clock circuit 46 in the embodiment; however, the date and time itself of the clock circuit 46 may be UTC date and time or system time inside the electronic timepiece 1. In this case, all of the home date and time and local time of each area are acquired as needed by converting the date and time of clock circuit 46 on the basis of the time difference and daylight saving time information of each area.

The embodiment has been described by taking a case where the positioning is performed on the basis of radio waves from GPS satellite and a case where the setting of current position is changed by user's input operation to the operation unit 49 and such like; however, the positioning method is not limited to the positioning based on radio waves from positioning satellites. The positioning method may be anything as long as the current position can be acquired independently from the whether or not daylight saving time is implemented.

The satellite is not limited to GPS satellite, and the positioning and acquisition of date and time may be performed by receiving radio waves from other positioning satellites such as GLONASS. Though the date and time data is determined for each positioning satellite, regardless of which satellite of radio waves is used to acquire the date and time, it is necessary to additionally acquire the time difference information and the daylight saving time information in order to calculate the local time.

The daylight saving time implementation information may be acquired from radio waves other than standard radio waves in the long-wavelength range, for example, radio waves in the middle wavelength range or the daylight saving time implementation information may be indirectly acquired via Near Field Communication and such like as long as it is possible to acquire information obtainable at an unspecified position independently from the information of current position by using a radio wave reception unit.

In the embodiment, priority information is explicitly stored for each area regarding which of the daylight saving time implementation information and daylight saving time implementation rule is to be used. However, as long as the application range of daylight saving time implementation information is stored for each standard radio waves, it is possible to determine which information is to be used with priority according to the current position and the application range. Thus, the specific determination method is not limited to the method shown in the embodiment.

The other specific details described in the embodiment such as the configurations, contents of processing operations and procedures may be modified appropriately within the scope of the present invention.

Though several embodiments of the present invention have been described above, the scope of the present invention is not limited to the above embodiments, and includes the scope of inventions, which is described in the scope of claims, and the scope equivalent thereof.

The entire disclosure of Japanese Patent Application No. 2014-147642 filed on Jul. 18, 2014 including description, claims, drawings, and abstract are incorporated herein by reference in its entirety.

What is claimed is:

1. An electronic timepiece comprising:

a clocking unit which counts current date and time;

a daylight saving time application unit which applies daylight saving time information corresponding to positional information to the date and time counted by the clocking unit;

a standard wave receiving unit which receives standard radio waves for correcting time, the standard radio waves including date and time information and daylight saving time implementation information of a predetermined area and being transmitted in a Low Frequency band;

a daylight saving time information acquisition unit which acquires the daylight saving time implementation information from the received radio waves;

a storage unit in which a daylight saving time implementation rule, standard wave receivable area information, and priority information are stored in advance for each of a plurality of areas of the world divided in advance, the standard wave receivable area information indicating whether a standard wave frequency receivable by the standard wave receiving unit is broadcast in the area, and the priority information indicating whether the daylight saving time implementation information included in the standard radio waves is to be selected with priority over the daylight saving time implementation rule in the area;

a positioning unit which receives radio waves from a satellite and measures a current position;

an operation unit which receives an operation for inputting a current position; and an information selection unit which:

determines whether the current position measured by the positioning unit or the current position input from the operation unit is in an area in which the standard wave frequency is receivable by the standard wave receiving unit based on the standard wave receivable area information stored in the storage unit, if the current position is not in the area in which the standard wave frequency is receivable, selects the daylight saving time implementation rule corresponding to the current position as the daylight saving time information, if the current position is in the area in which the standard wave frequency is receivable, determines whether the current position measured by the positioning unit or the current position input from the operation unit is in an area in which the daylight-saving time implementation information is selected with priority over the daylight saving time implementation rule based on the priority information, if the current position is not in the area in which the daylight saving time implementation information is selected with priority over the daylight saving time implementation rule, selects the daylight saving time implementation rule corresponding to the current position as the daylight saving time information, and if the current position is in the area in which the daylight saving time implementation information is selected with priority over the daylight saving time implementation rule, selects, as the daylight saving time information, the daylight saving time implementation information acquired by the daylight saving time information acquisition unit within a predetermined period of time, wherein the daylight saving time application unit applies the selected daylight saving time information to the date and time.

2. The electronic timepiece according to claim 1, wherein the priority information is determined to indicate selecting the daylight saving time implementation information with priority for an area where daylight saving time is implemented during a same period of time as a period of time indicated by the daylight saving time implementation information included in the radio waves which are receivable by the standard wave receiving unit.

3. The electronic timepiece according to claim 2, wherein the operation unit further receives an operation for changing the priority information in the storage unit.

4. The electronic timepiece according to claim 3, wherein the information selection unit newly selects the daylight saving time information based on the current position when the positioning unit measures the current position.

5. The electronic timepiece according to claim 2, wherein the information selection unit newly selects the daylight saving time information based on the current position when the positioning unit measures the current position.

6. The electronic timepiece according to claim 1, wherein the operation unit further receives an operation for changing the priority information in the storage unit.

7. The electronic timepiece according to claim 6, wherein the information selection unit newly selects the daylight saving time information based on the current position when the positioning unit measures the current position.

8. The electronic timepiece according to claim 1, wherein the information selection unit newly selects the daylight saving time information based on the current position when the positioning unit measures the current position.

* * * * *